US010508424B2

(12) United States Patent
Huang et al.

(10) Patent No.: US 10,508,424 B2
(45) Date of Patent: Dec. 17, 2019

(54) CONNECTING STRUCTURE OF OUTLET TERMINAL AND JET REGULATOR

(71) Applicant: XIAMEN SOLEX HIGH-TECH INDUSTRIES CO., LTD., Xiamen, Fujian (CN)

(72) Inventors: Feilong Huang, Fujian (CN); Shilong Wu, Fujian (CN); Guosong Zhao, Fujian (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 105 days.

(21) Appl. No.: 15/389,016

(22) Filed: Dec. 22, 2016

(65) Prior Publication Data

US 2018/0002906 A1 Jan. 4, 2018

(30) Foreign Application Priority Data

Jul. 1, 2016 (CN) ..... 2016 1 0515588

(51) Int. Cl.
*E03C 1/086* (2006.01)
*E03C 1/084* (2006.01)

(52) U.S. Cl.
CPC ..... *E03C 1/086* (2013.01); *E03C 1/084* (2013.01)

(58) Field of Classification Search
CPC . E03C 1/086; E03C 1/084; E03C 1/08; E03C 1/04; E03C 1/0405; E03C 1/102; F16K 1/123; B05B 7/0416; B05B 7/0458; B05B 7/0425; B05B 7/0433; B05B 1/1654; B05B 1/1672; B01F 3/04007
USPC .... 239/437, 446, 428.5, 428, 397, 575, 588, 239/590.3, 600
See application file for complete search history.

(56) References Cited

U.S. PATENT DOCUMENTS

2005/0040256 A1* 2/2005 Santos ..... B05B 3/003 239/380
2014/0291419 A1* 10/2014 Pitsch ..... B05B 1/169 239/437
2015/0176741 A1* 6/2015 Juan ..... F16L 37/48 285/8
2017/0138027 A1* 5/2017 Chuang ..... E03C 1/04

* cited by examiner

*Primary Examiner* — Alexander M Valvis
*Assistant Examiner* — Qingzhang Zhou
(74) *Attorney, Agent, or Firm* — Rabin & Berdo, P.C.

(57) ABSTRACT

A connecting structure of an outlet terminal and a jet regulator includes an outlet terminal and a jet regulator, the outlet terminal has an outlet passage, the jet regulator is detachably assembled in the outlet passage in the outlet direction, the jet regulator is disposed with a fixing shell portion, the inner wall of the outlet passage of the outlet terminal is concaved with a lock groove, the fixing shell portion is disposed with an assembly hole corresponding to the lock groove; the connecting structure comprises a lock portion and a retractable slide shaft driving mechanism with retracted and extended states, the lock portion is movably connected to the assembly hole and is movable between a lock position and a unlock position, the lock portion inserts to the lock groove in lock position and retracts to the assembly hole and leaves away from the lock groove in unlock position.

10 Claims, 11 Drawing Sheets

CONNECTING STRUCTURE OF OUTLET TERMINAL AND JET REGULATOR

FIELD OF THE INVENTION

The present invention relates to a quick assembly and disassembly connecting structure of an outlet terminal and a jet regulator.

BACKGROUND OF THE INVENTION

A connecting structure of an outlet terminal and a jet regulator comprises an outlet terminal and a jet regulator, the outlet terminal is disposed with an outlet passage, the jet regulator is detachably assembled in the outlet passage in the outlet direction, the jet regulator is disposed with a fixing shell portion, the outlet passage is disposed with internal thread, the fixing shell portion is disposed with an external thread, the fixing shell portion is fixedly assembled in the outlet passage by the thread connection. It has disadvantages: 1. the thread increases manufacturing cost, the screw teeth are easily damaged; 2. the fixing shell portion needs to dispose with protrusion for user to rotate, otherwise specific device is needed to assemble and disassemble; 3. operation is not convenient to screw-in or screw-out with circles.

SUMMARY OF THE INVENTION

The present invention is provided with a quick assembly and disassembly connecting structure of an outlet terminal and a jet regulator, which overcomes the disadvantages of the traditional technology.

The technical solution of the present invention is that:

A quick assembly and disassembly connecting structure of an outlet terminal and a jet regulator, comprising an outlet terminal and a jet regulator, the outlet terminal is disposed with an outlet passage, the jet regulator is detachably assembled in the outlet passage in the outlet direction, the jet regulator is disposed with a fixing shell portion, wherein the inner wall of the outlet passage of the outlet terminal is concaved with a lock groove, the fixing shell portion is disposed with an assembly hole corresponding to the lock groove;

the connecting structure comprises a lock portion and a retractable slide shaft driving mechanism with retracted and extended states, the lock portion is movably connected to the assembly hole and is movable between a lock position and a unlock position, the lock portion inserts to the lock groove in lock position and retracts to the assembly hole and leaves away from the lock groove in unlock position, the retractable slide shaft driving mechanism is assembled to the jet regulator and is connected to the lock portion in transmission way, the retractable slide shaft driving mechanism is operated to change between two states to drive the lock portion to the lock position and the unlock position.

In another preferred embodiment, the jet regulator comprises a divider, the divider is fixedly assembled in the fixing shell portion, the assembly hole passes throughout of the fixing shell portion, the fixing shell portion is coupled to the outlet passage.

In another preferred embodiment, the retractable slide shaft driving mechanism comprises an assembly through hole disposed in the divider, a button movable connected to the assembly through hole, a push rod movably connected to the assembly through hole and an elastic body abutting against the push rod and the jet regulator; the assembly through hole, the button and the push rod are respectively disposed with coupling incline teeth.

In another preferred embodiment, the retractable slide shaft driving mechanism is disposed in the divider and is disposed with a push rod; the lock portion comprises a plurality of balls movably disposed in the assembly hole; a position block is disposed between the lock portion and the push rod, the position block is fixedly connected to the push rode, a first guiding mechanism is disposed between the end of the position block and the balls; with the first guiding mechanism, the position block moves to drive the balls to move to the lock position; a second guiding mechanism is disposed between the lock groove and the balls; with the second guiding mechanism, the balls move to the unlock position.

In another preferred embodiment, the end of the position block is disposed with a first guiding surface and a side surface connected to the first guiding surface parallel to the motion direction of the position block, the first guiding surface and the ball couple to form the first guiding mechanism, the side surface abuts against the balls to keep the balls in the lock position; the lock groove is disposed with a second guiding surface, the second guiding surface and the balls couple to form the second guiding mechanism.

In another preferred embodiment, the fixing shell portion comprises a fixing ring and a guiding ring, the top end face of the fixing ring is concaved with a bottom throughout groove passing through the fixing ring inside and outside, the bottom end face of the guiding ring is concaved with a top throughout groove passing through the guiding ring inside and outside; the guiding ring and the fixing ring are fixed from up to down, the bottom throughout groove and the top throughout groove couple to form above mentioned assembly hole; the end of the position block slidably passes through the top throughout groove, the balls are movably connected to the bottom throughout groove in coupling way.

In another preferred embodiment, the size of the bottom throughout groove is gradually decreased from inside to outside, the width of the external opening of the bottom throughout groove is smaller than the diameter of the ball.

In another preferred embodiment, the retractable slide shaft driving mechanism is disposed in the divider and is disposed with a push rod; the lock portion comprises a sliding block, a guiding mechanism is disposed between the push rod and the sliding block, the sliding block is slidably connected to the assembly hole, the end of the sliding block in the lock position extends out of the assembly hole and inserts to the lock groove, the end of the sliding block in the unlock position retracts to the assembly hole and leaves away from the lock groove.

In another preferred embodiment, the sliding block is disposed with an elastically deformable suspending sheet, the extending and retracting state of the push rod are respectively corresponding to the unlock position and lock position of the sliding block, the suspending sheet is compressed to restore energy during the sliding block moving from the lock position to the unlock position to generate an elastic force applying on the sliding block from the unlock position to the lock position.

In another preferred embodiment, the sliding block is disposed with two suspending sheets axially symmetrical arranged with respect to the sliding direction, two suspending sheets form a splay shape with opening inwardly, two suspending sheets doesn't leave away from the assembly hole when the sliding block is in the lock position.

In another preferred embodiment, the sliding block is fixedly disposed with an elastically deformable suspending sheet, the extending and retracting state of the push rod are respectively corresponding to the unlock position and lock position of the sliding block, the suspending sheet is compressed to restore energy during the sliding block moving from the lock position to the unlock position to generate an elastic force applying on the sliding block from the unlock position to the lock position.

In another preferred embodiment, the sliding block is disposed with two suspending sheets axially symmetrical arranged with respect to the sliding direction, two suspending sheets form a splay shape with opening inwardly, two suspending sheets doesn't leave away from the assembly hole when the sliding block is in the lock position.

Compared to the traditional technology, the technical solution of the present invention has following advantages:

The retractable slide shaft driving mechanism is used to control the lock portion in the lock position and the unlock position, the lock portion controls the outlet terminal to lock and unlock to the jet regulator, therefore, the present invention overcomes the disadvantages of the traditional technology and provides following effects: 1. the retractable slide shaft driving mechanism is combined with the lock portion in sliding way and applying in the assembly of the jet regulator, on one hand, lock and unlock can be realized by only pressing the retractable slide shaft driving mechanism, the lock and unlock are fast and convenient, the jet regulator can be pulled out directly after unlock, thus realizing quick assembly and disassembly; on the other hand, the structure is compact and simple, the effect is particularly obvious in the assembly field of the small space occupied jet regulator; 2. the outlet terminal is disposed with a lock groove to realize lock and unlock, the structure is simple. The lock portion comprises a plurality of balls movably disposed in each assembly hole; a position block 330 is disposed between the lock portion and the push rod, the position block is fixedly connected to the push rode, a first guiding mechanism is disposed between the end of the position block and the balls; with the first guiding mechanism, the position block moves to drive the balls to move to the lock position; a second guiding mechanism is disposed between the lock groove and the balls; with the second guiding mechanism, the balls can move to the unlock position. The structure is simple, the cost is low, stuck is avoided.

The fixing shell portion comprises a fixing ring and a guiding ring, the top end face of the fixing ring is concaved with a bottom throughout groove passing through the fixing ring inside and outside, the bottom end face of the guiding ring is concaved with a top throughout groove passing through the guiding ring inside and outside, the assembly is convenient, the components are convenient to manufacture, the manufacturing costs low.

BRIEF DESCRIPTION OF THE DRAWINGS

The present invention will be further described with the drawings and embodiments.

DETAILED DESCRIPTION OF THE EMBODIMENTS

Figure 1:
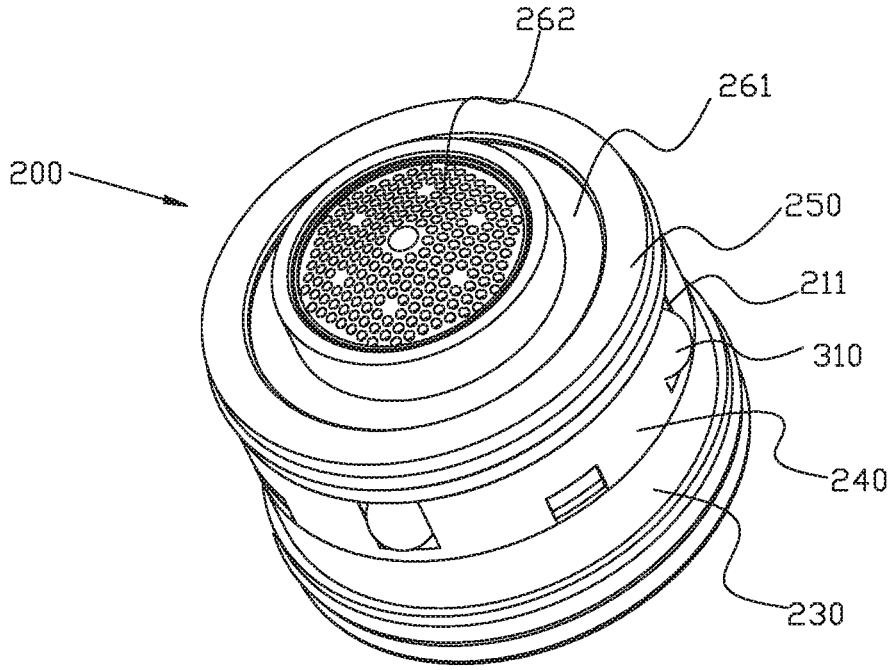
FIG. 1 illustrates a schematic diagram of a jet regulator of a first preferred embodiment of the present invention.
Figure 2:
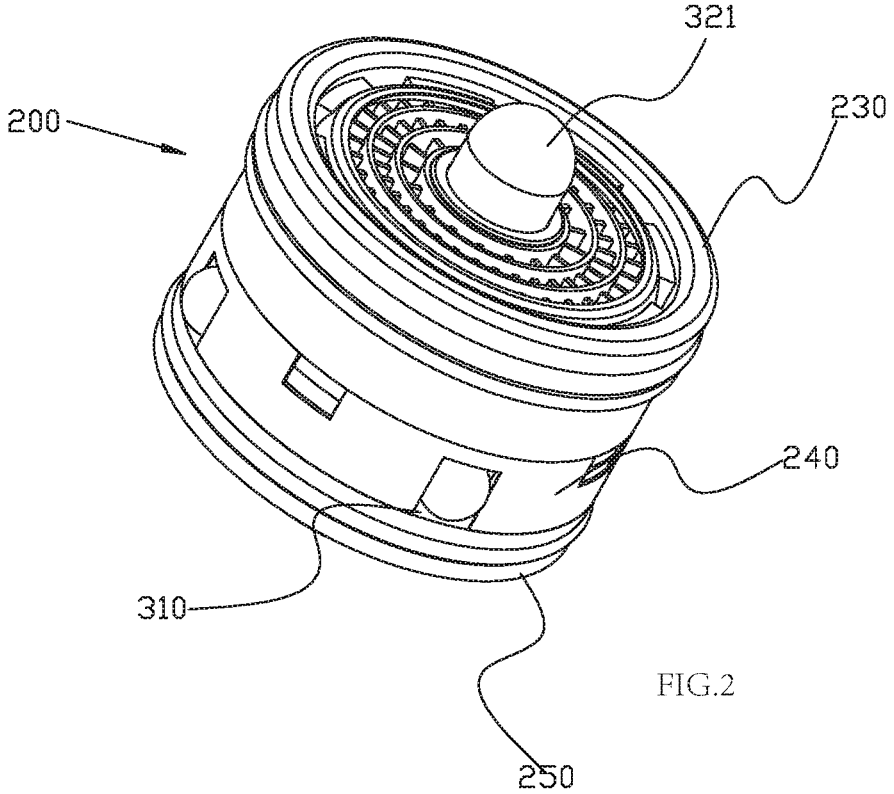
FIG. 2 illustrates a schematic diagram of the jet regulator of the first preferred embodiment of the present invention from another view angle.
Figure 3:
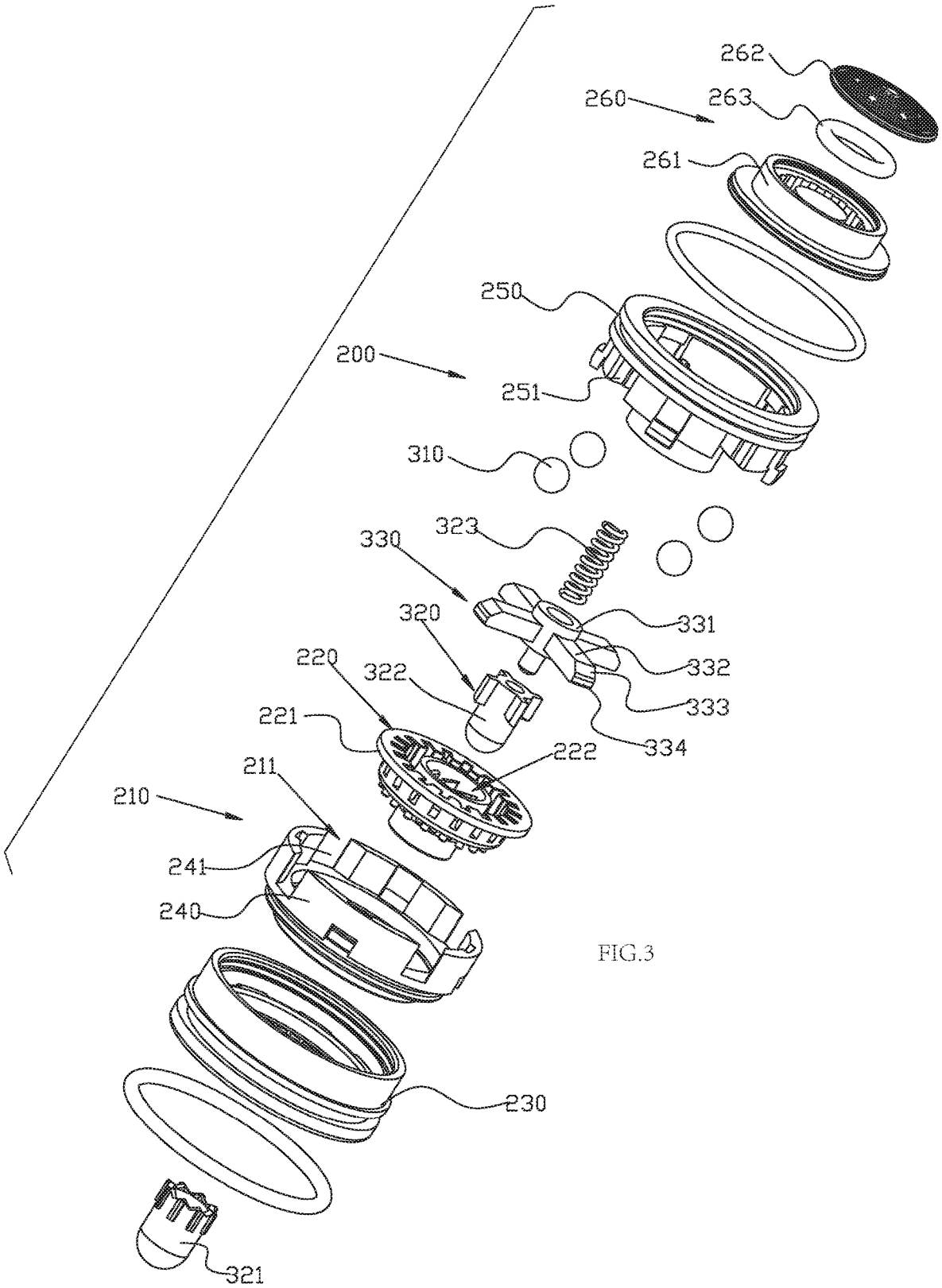
FIG. 3 illustrates an exploded and schematic diagram of the jet regulator of the first embodiment.
Figure 4:
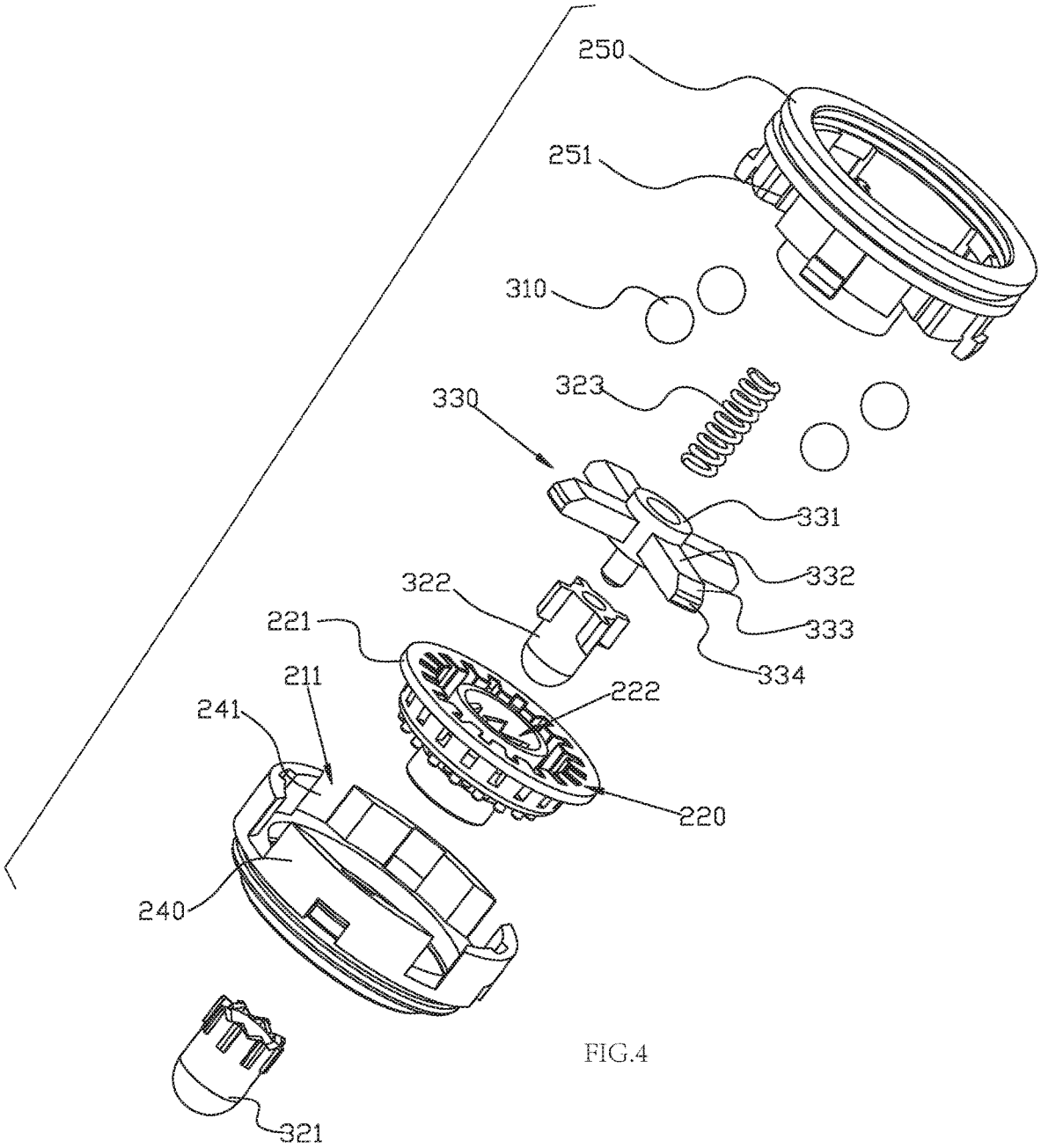
FIG. 4 illustrates a partial exploded and schematic diagram of the jet regulator of the first embodiment.
Figure 5:
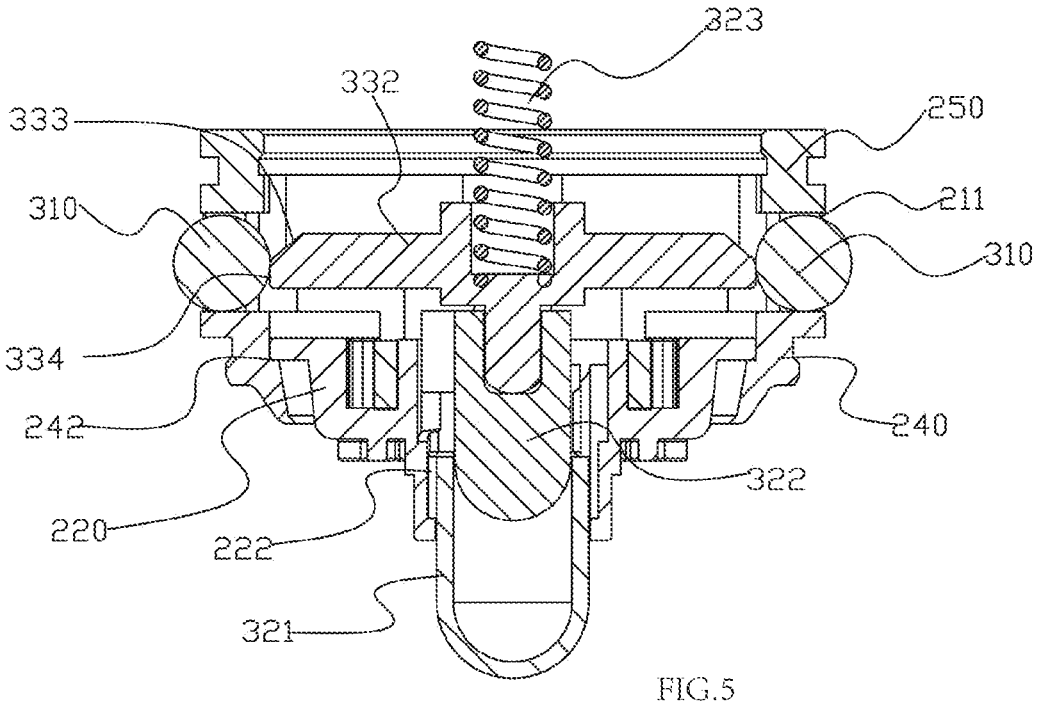
FIG. 5 illustrates a partial sectional diagram of the jet regulator of the first embodiment.
Figure 6:
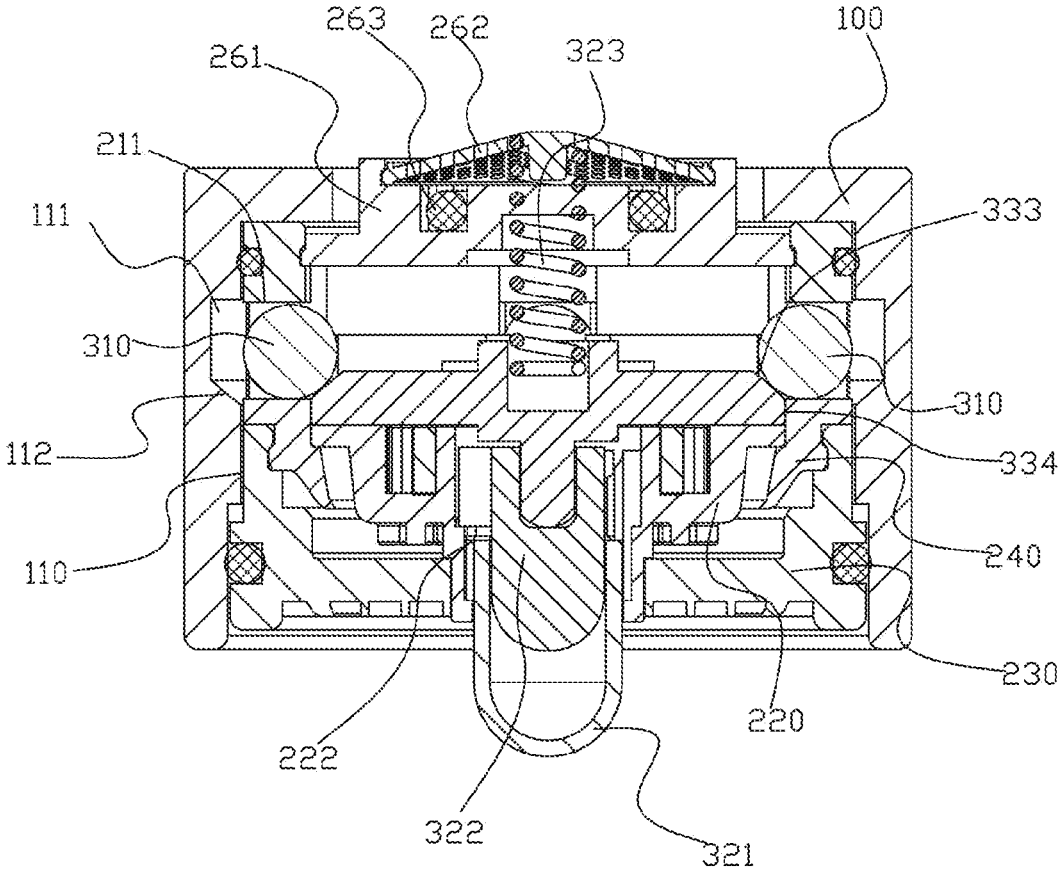
FIG. 6 illustrates a sectional diagram of a quick assembly and disassembly connecting structure in unlock state of the first embodiment.
Figure 7:
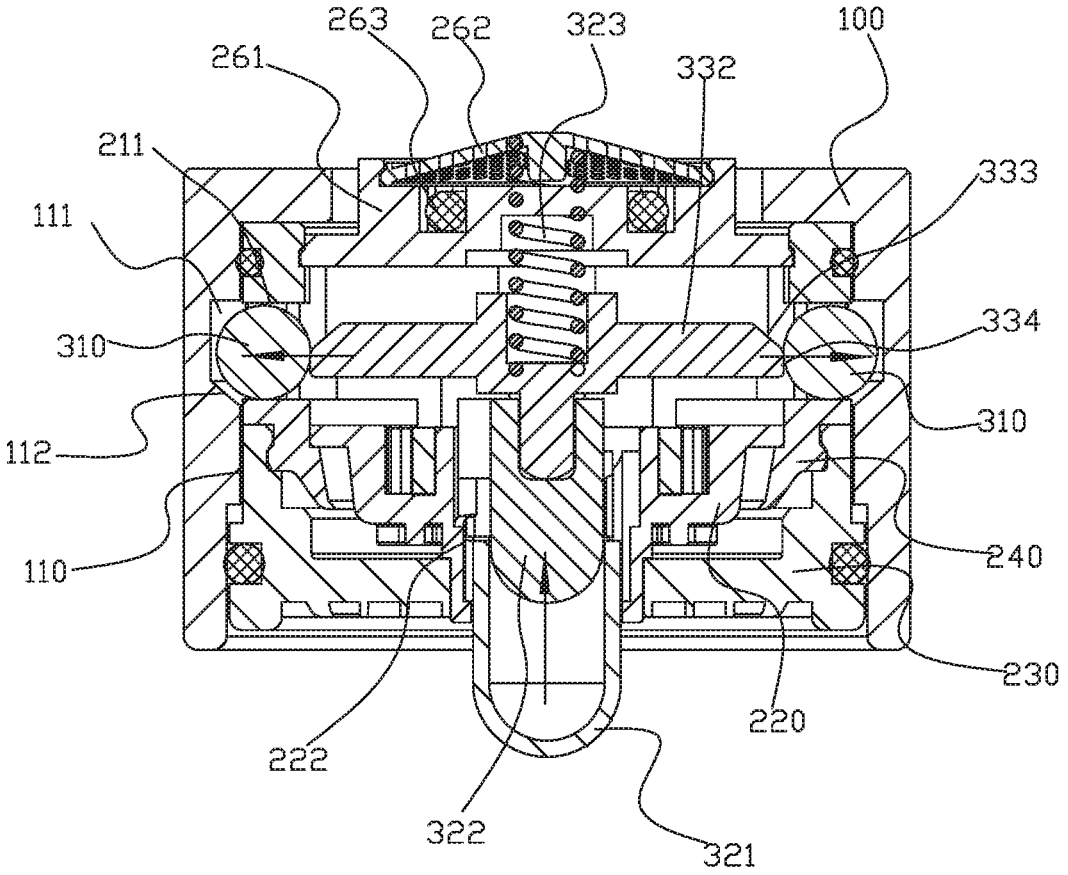
FIG. 7 illustrates a sectional diagram of the quick assembly and disassembly connecting structure in lock state of the first embodiment.

A quick assembly and disassembly connecting structure of an outlet terminal and a jet regulator, referring to FIGS. 1-7, comprises an outlet terminal 100 and a jet regulator 200, the outlet terminal 100 is disposed with an outlet passage 110, the jet regulator 200 is detachably assembled in the outlet passage 110, the jet regulator 200 is disposed with a fixing shell portion 210. The inner wall of the outlet passage 110 of the outlet terminal 100 is concaved with a lock groove 111, the lock groove 111 can be a plurality of grooves arranged with space in the periphery of the inner wall of the outlet passage 110 or an annular groove arranged in the inner wall, preferred, it is an annular groove to assemble with convenience, avoiding aligning the lock groove and the lock portion.

The fixing shell portion 210 is coupled to the outlet passage 110, for example, the fixing shell portion is assembled in the outlet passage 110 and the outer wall of the fixing shell portion 210 is contacted with the inner wall of the outlet passage 110, the external diameter of the outer wall is coupled to the internal diameter of the inner wall, equal or well-matched. The fixing shell portion 210 is disposed with an assembly space, the fixing shell portion 210 is disposed with an assembly hole 211 corresponding to the lock groove 111 passing through the assembly space inside and outside, at least two assembly holes are preferred, they are arranged with space in the periphery; the jet regulator 200 comprises a divider 220, the divider 220 is fixedly assembled in the assembly space of the fixing shell portion 210. The divider is used to divide the flowing, for example, it is disposed with a plurality of diversion holes to make the water flowing form jet.

The fixing shell portion 210 comprises a main body 230, a fixing ring 240 and a guiding ring 250. The main body 230 comprises a first periphery wall and a grating portion fixedly connected to the lower portion of the first periphery wall; the fixing ring 240 comprises a second periphery wall, the lower portion of the second periphery wall is disposed in the first periphery wall, the second periphery wall is disposed with a protrusion, the first periphery wall is disposed with a groove, the protrusion and the groove are coupled to lock the periphery walls together. The top end face of the second periphery wall of the fixing ring 240 is concaved with a bottom throughout groove 241 passing through the fixing ring inside and outside, the guiding ring 250 is disposed with a third periphery wall, the bottom end face of the third periphery wall of the guiding ring 250 is concaved with a top throughout groove 251 passing through the guiding ring 250 inside and outside, the top throughout groove and the bottom throughout groove are aligned in the periphery; the guiding ring and the fixing ring are fixed from up to down. The fixing method is for example: the third periphery wall is disposed in the second periphery wall, with the coupling of the protrusion and the groove, they are locked and fixed, the bottom throughout groove 241 and the top throughout groove 251 couple to form above mentioned assembly hole 211.

The inner wall of the fixing ring 240 is disposed with a step surface 242 faced upwardly, the external periphery of the upper portion of the divider is protruding to form a protruding annular flange 221, the protruding annular flange 221 is located on the step surface 242, such to position the divider. The central portion of the divider 220 is disposed with an assembly through hole 222 passing through the divider up and down.

The connecting structure comprises a lock portion 310 and a retractable slide shaft driving mechanism 320 with retracted and extended states, the lock portion 310 is movably connected to the assembly hole 211 and is movable between a lock position and a unlock position, the lock portion 310 inserts to the lock groove 111 in lock position, the lock portion limits the jet regulator to move with respect the jet regulator along the outlet direction, the jet regulator and the outlet terminal are fixedly assembled; the lock portion retracts to the assembly hole and leaves away from the lock groove in unlock position, such that the jet regulator can move with respect to the outlet terminal along the outlet direction, the jet regulator and the outlet terminal are separated in unlock state. The retractable slide shaft driving mechanism is assembled to the jet regulator and is connected to the lock portion in transmission way, the retractable slide shaft driving mechanism 320 is operated to change between two states to drive the lock portion to switch between the lock position and the unlock position.

The retractable slide shaft driving mechanism 320 comprises above mentioned assembly through hole 222 disposed in the divider, a button 321 movable connected to the assembly through hole, a push rod 322 movably connected to the assembly through hole and an elastic body 323 abutting against the push rod and the jet regulator; the assembly through hole, the button and the push rod are respectively disposed with coupling incline teeth, they are coupled to form the retractable slide shaft driving mechanism 320. The button 321 slidably passes through the through hole of the grating portion for user to press. User can press the button 321 to drive the lock portion 310 to move from the lock position to the unlock position or to move from the unlock position to the lock position.

Preferred, the jet regulator further comprises a filter 260, which is fixedly assembled on the guiding ring 250 to filter water flowing through the filter 260, then water is divided through the divider, negative pressure generates when the divided water enters the mutation cavity, the negatively pressure makes air at the outer side enter the mutation cavity through an air passage disposed in the fixing shell portion, the spraying water and the air mix to generate bubble water, the bubble water is rectified by the grating portion and then flows out. In other case, the filter is ignored, water directly flow to the divider. The filter 260, for example, comprises a fixing base 261 assembled to the guiding ring and a filter screen 262 assembled to the fixing base, the fixing base is disposed with a water passage, as needed, the fixing base can be further disposed with an elastic sealing ring 263, which is assembled to the fixing base, water is saved by the coupling of the sealing ring and the fixing base, the sealing ring is deformed under the water pressure, the deformed portion closes a portion of the water passage, larger portion is closed under high water pressure, so the flowing area is relatively small; smaller portion is closed under low water pressure, so the flowing area is relatively large.

The lock portion 310 comprises a plurality of balls movably disposed in each assembly hole; a position block 330 is disposed between the lock portion 310 and the push rod 322, the position block 330 is fixedly connected to the push rode 322, such that the push rod slides to drive the position block to slide up and down or axially slide; a first guiding mechanism is disposed between the end of the position block 330 and the balls; with the first guiding mechanism, the position block moves up and down or slides in the axial direction to drive the balls to move to the lock position in lateral direction or radial direction; a second guiding mechanism is disposed between the lock groove and the balls; when the fixing shell portion is pulled out, the second guiding mechanism squeezes the balls and makes the balls move to the unlock position from the lock position.

The position block 330 comprises a center base 331 fixedly connected to the push rod 322 and a protruding arm 332 fixedly connected to the upper portion of the center base 331 with space in the periphery, the end face of the protruding arm 332 is disposed with a first guiding surface 333 and a side surface 334 parallel to the motion direction of the position block which is connected to the first guiding surface, the first guiding surface and the ball couple to form the first guiding mechanism, the side surface abuts against the balls to keep the balls in the lock position; the bottom groove wall of the lock groove 111 is disposed with a second guiding surface 112, the second guiding surface and the balls couple to form the second guiding mechanism. The first and second guiding surface, for example is incline surface or conical surface.

The end of the protruding arm 332 of the position block slidably passes through the top throughout groove 251, the ball of the lock position is movably connected to the bottom throughout groove. Preferred, the size of the bottom throughout groove is gradually decreased from inside to outside, the width of the external opening of the bottom throughout groove is smaller than the diameter of the ball, such to limit the ball to escape from the assembly hole.

The assembly process: the jet regulator 200 is detachably assembled in the outlet passage 110 in the outlet direction, the assembly hole is aligned to the lock groove (as needed, a step surface is disposed in the outlet passage, when the jet regulator abuts against the step surface, the aligning is in place), pressing the button 321 of the retractable slide shaft driving mechanism 320, the push rod 322 is pushed to the extending position from the retracting position (from the retracting state to the extending state, the retracting position is similar to the retracting state of a retractable ball-point pen, the extending state is similar to the extending state of a retractable ball-point pen), during this process, the ball moves to lock state from unlock state by the first guiding surface, after the pushing is in place, the side surface just abuts against the ball, the ball is partially placed in the lock groove and partially in the assembly hole, thus to lock the jet regulator 200 and the outlet passage, avoiding relative displacement and axial movement. In the disassembly process: pressing the button 321, the push bar is reset to the retracting position from the extending position, the surface corresponding to the ball is changed from the side surface to the first guiding surface; pulling the jet regulator out, the ball is squeezed by the second guiding surface, the ball moves inwardly to the unlock position from the lock position, the jet regulator is then completely pulled out.

Figure 8:
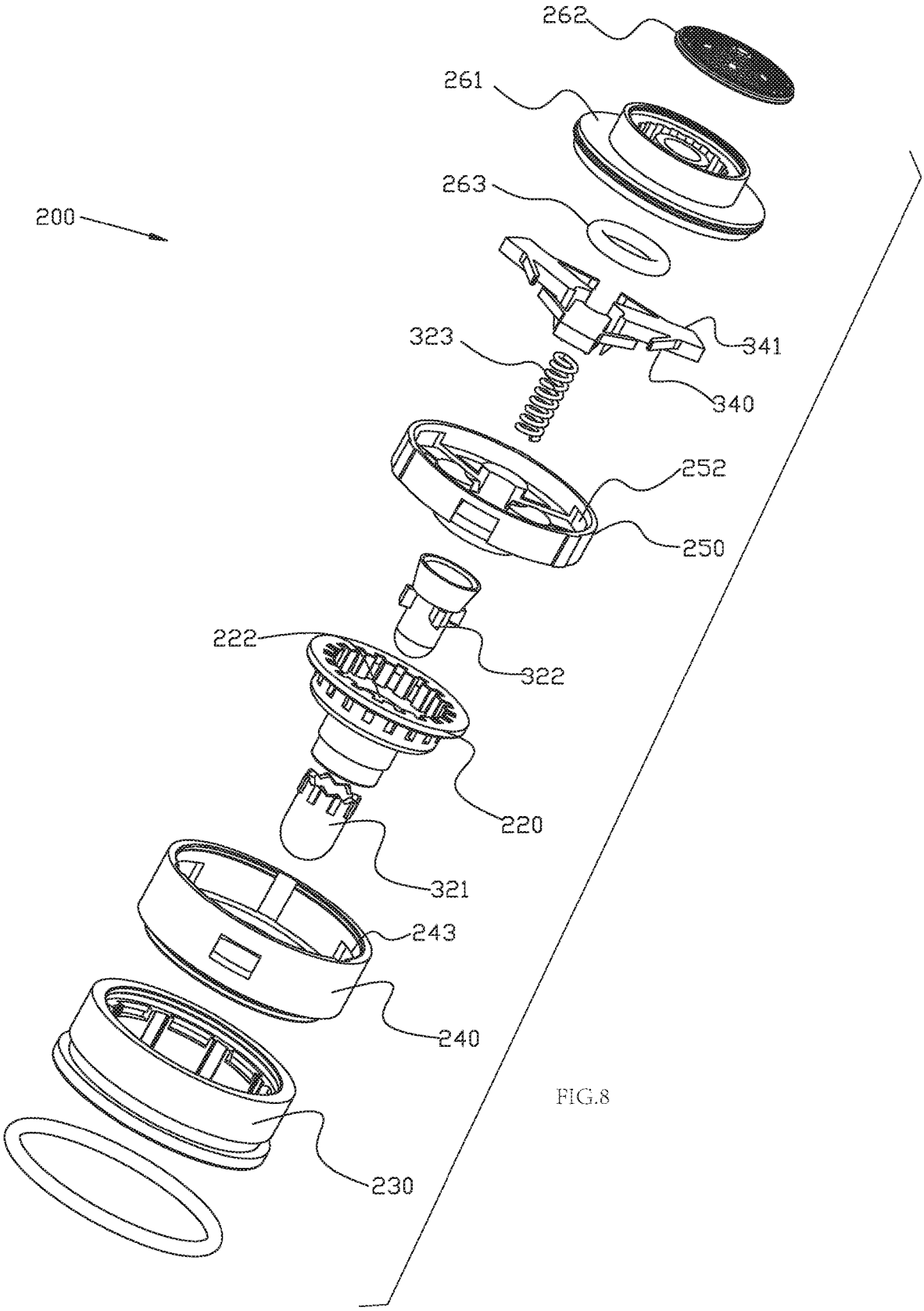
FIG. 8 illustrates an exploded and schematic diagram of a jet regulator of a second embodiment.
Figure 9:
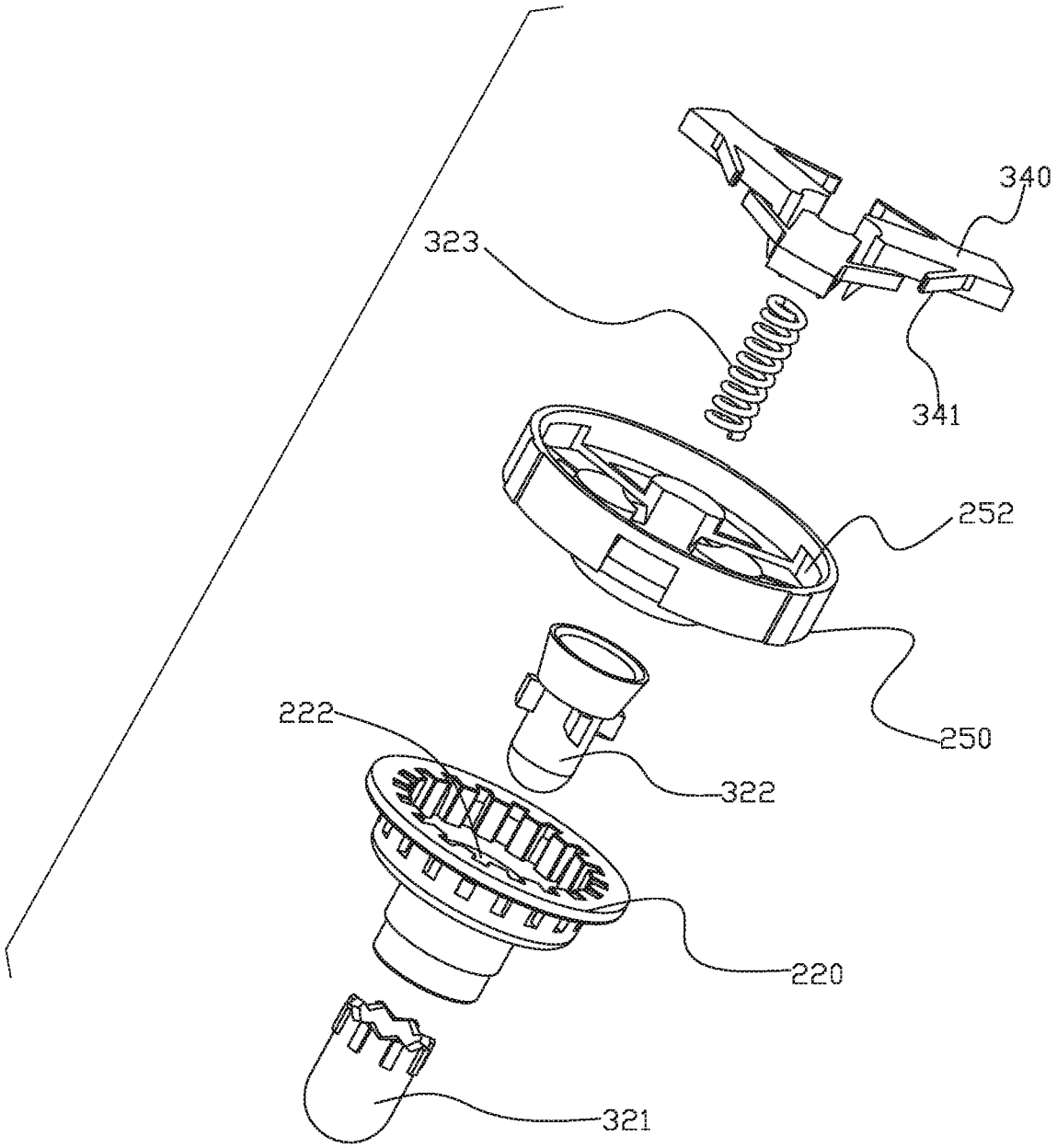
FIG. 9 illustrates a partial exploded and schematic diagram of the jet regulator of the second embodiment.
Figure 10:
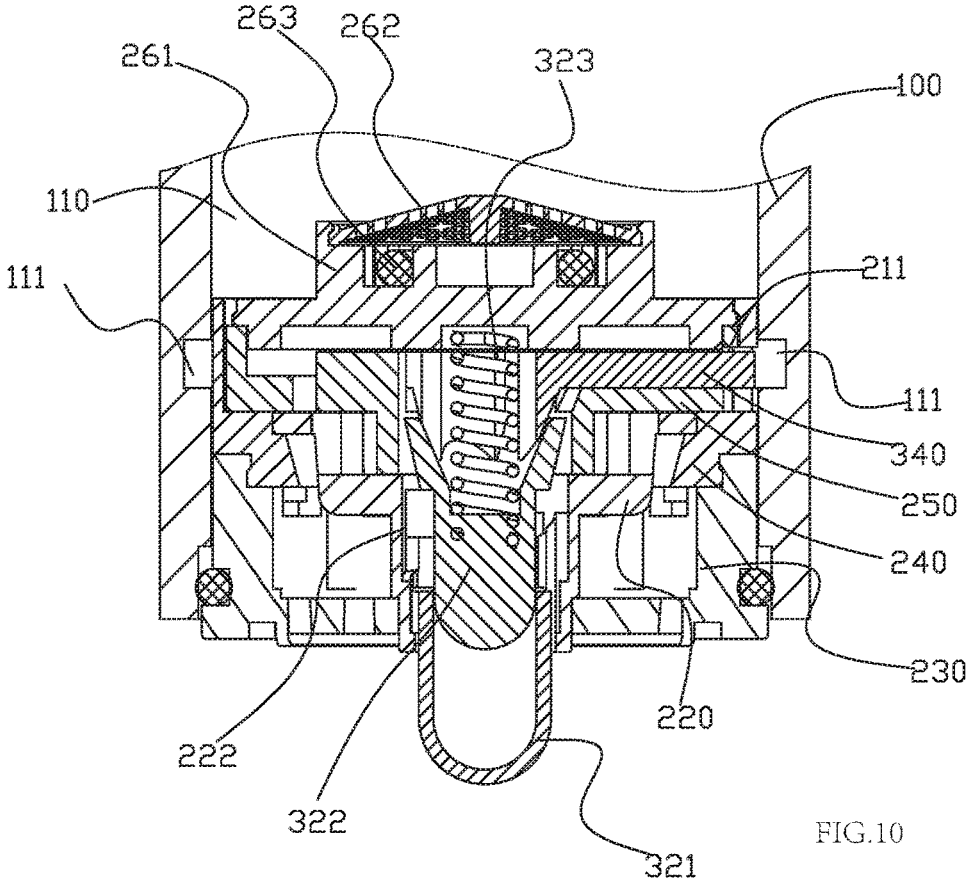
FIG. 10 illustrates a sectional diagram of a quick assembly and disassembly connecting structure in unlock state of the second embodiment.
Figure 11:
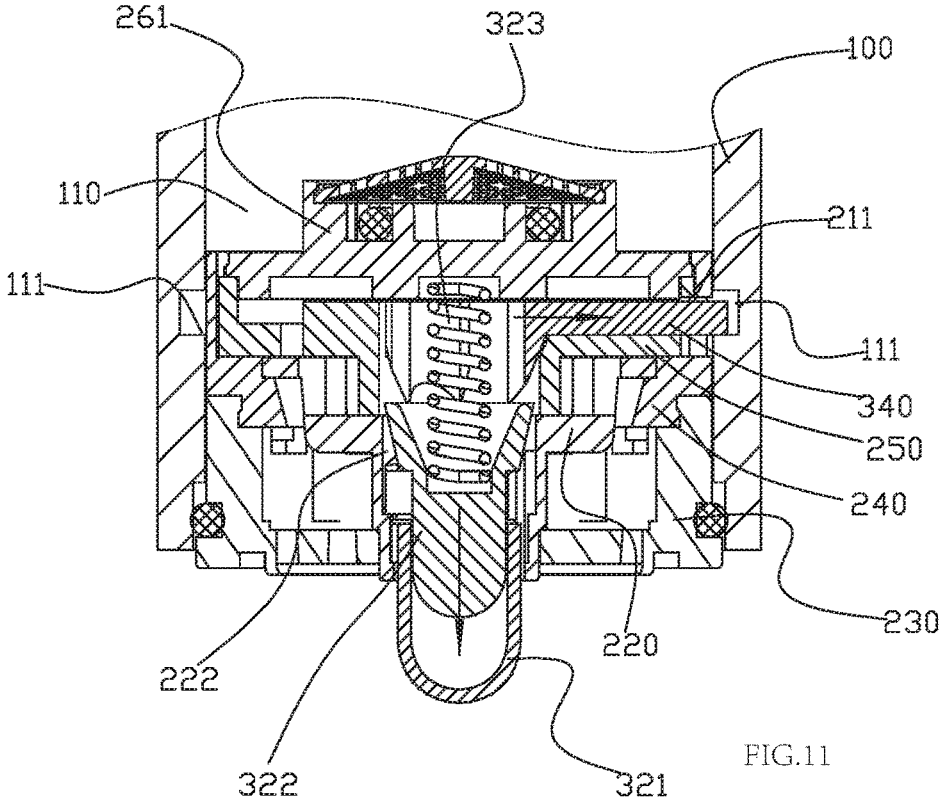
FIG. 11 illustrates a sectional diagram of the quick assembly and disassembly connecting structure in lock state of the second embodiment.

The second embodiment: this embodiment differs form the first embodiment in that: referring to FIGS. 8-11, the lock portion comprises sliding block 340 with same number as the assembly holes, a guiding mechanism is disposed between the push rod 322 and the sliding block 340, the sliding block 340 is slidably connected to the assembly hole 211. The guiding mechanism, for example, is applied with incline surface coupling, the push rod slides (for example in the axial direction) to drive the sliding block 340 to slide along the assembly hole, for example, in the radial direction; in detailed: the push rod changes from the extending position to the retracting position to drive the sliding block to move from the lock position to the unlock position, the extending and retracting state of the push rod are respectively corresponding to the unlock position and lock position of the sliding block. The end of the sliding block in the lock position extends out of the assembly hole 211 and inserted to the lock groove 111, the end of the sliding block in unlock position retracts to the assembly hole 211 and leaves away from the lock groove 111. The sliding block 340 is disposed with two suspending sheets 341 axially symmetrical arranged with respect to the sliding direction, two suspending sheets are elastically deformable, the suspending sheet is compressed to restore energy during the sliding block moving from the lock position to the unlock position to generate an elastic force applying on the sliding block from the unlock position to the lock position. Two suspending sheets form a splay shape with opening inwardly, two suspending sheets doesn't leave away from the assembly hole when the sliding block is in the lock position. The guiding mechanism, for example, a guiding block is extending out of the sliding block, the guiding block is disposed with a guiding surface, the push rod is concaved with a guiding groove, the guiding block is disposed in the guiding groove, the guiding surface is coupled to the groove wall of the guiding groove. The guiding ring is disposed with an external sliding groove 243 passing through the guiding ring inside and outside, the fixing ring is disposed with an internal sliding groove 252 passing through the fixing ring inside and outside, the fixing ring is fixedly assembled in the fixing ring, the internal and external sliding groove are aligned to form the assembly hole.

The assembly process: the jet regulator 200 is detachably assembled in the outlet passage 110 in the outlet direction, the assembly hole is aligned to the lock groove, pressing the button 321 of the retractable slide shaft driving mechanism, the push rod 322 is pushed to the retracting position from the extending position, during this process, the abutting to the sliding block is released, the elastic force of the suspending sheet makes the sliding block reset to the lock position. The unlocking process: pressing the button 321, the push rod 322 is pushed to the extending position from the retracting position, the sliding block is subjected to the push rod and slides from the lock position to the unlock position, the unlock is released, the suspending sheet is compressed to store energy, the jet regulator is pulled out. The assembly is convenient; the operation is convenient and labor saving.

Figure 12:
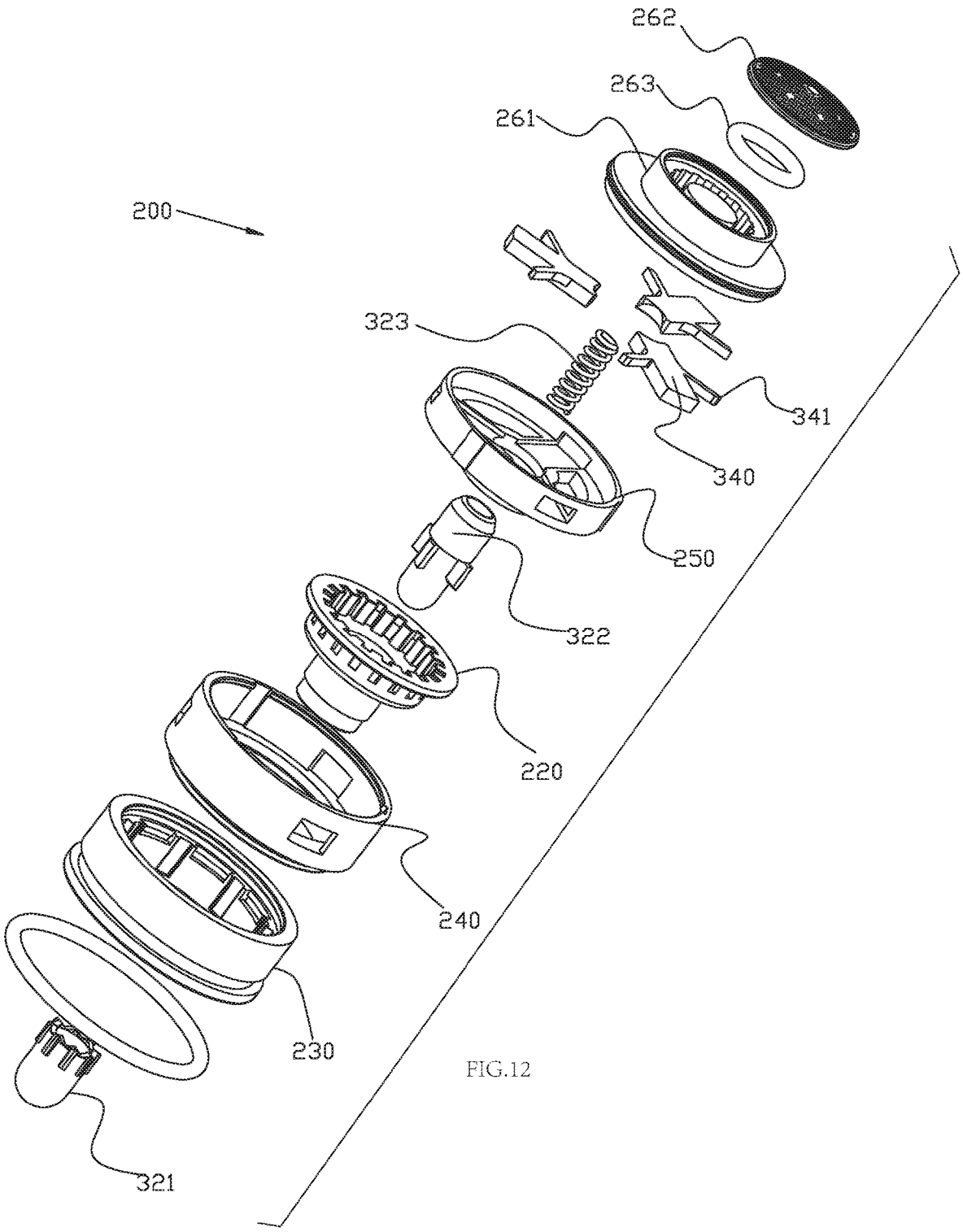
FIG. 12 illustrates an exploded and schematic diagram of a jet regulator of a third embodiment.
Figure 13:
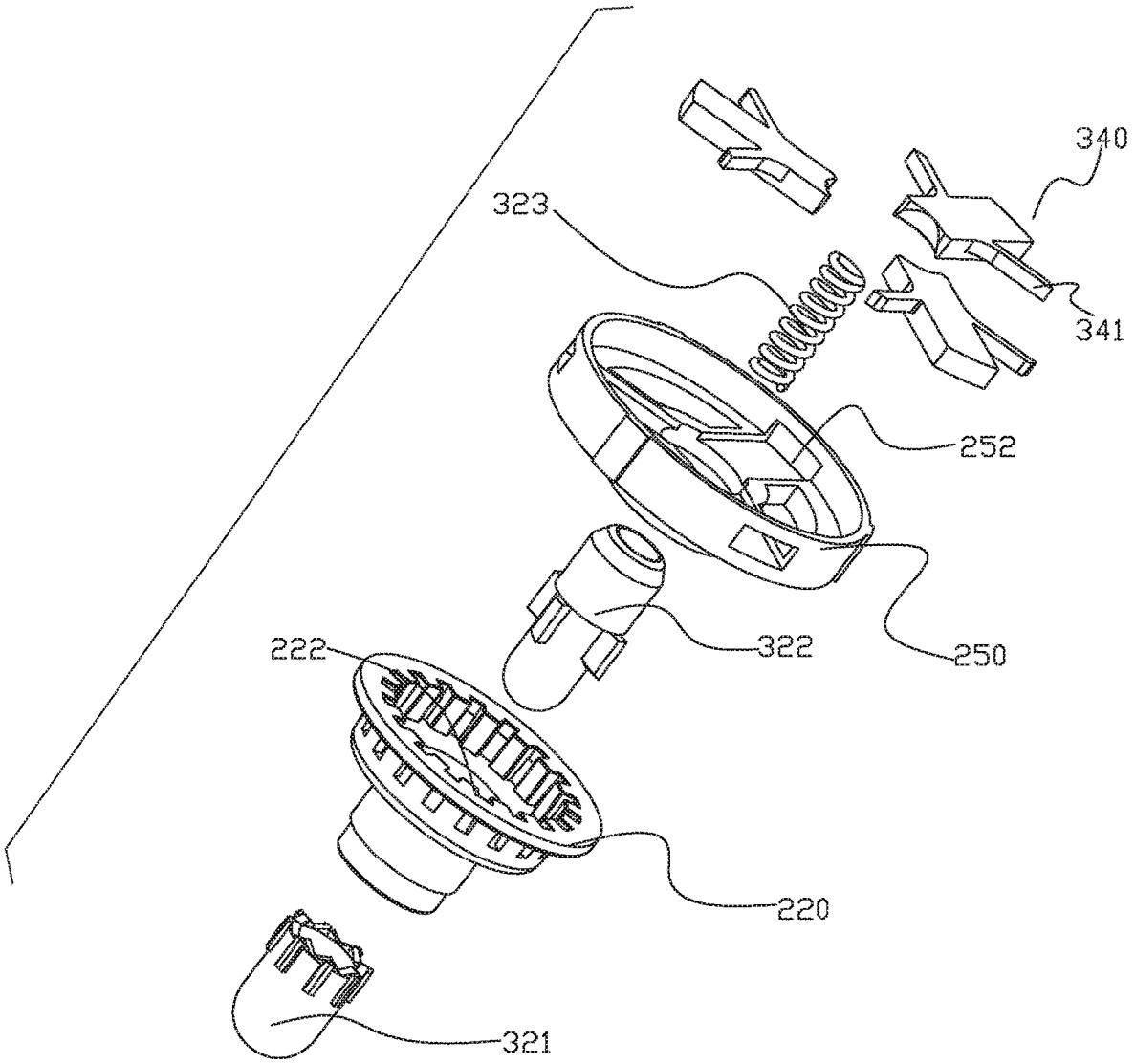
FIG. 13 illustrates a partial exploded and schematic diagram of the jet regulator of the third embodiment.
Figure 14:
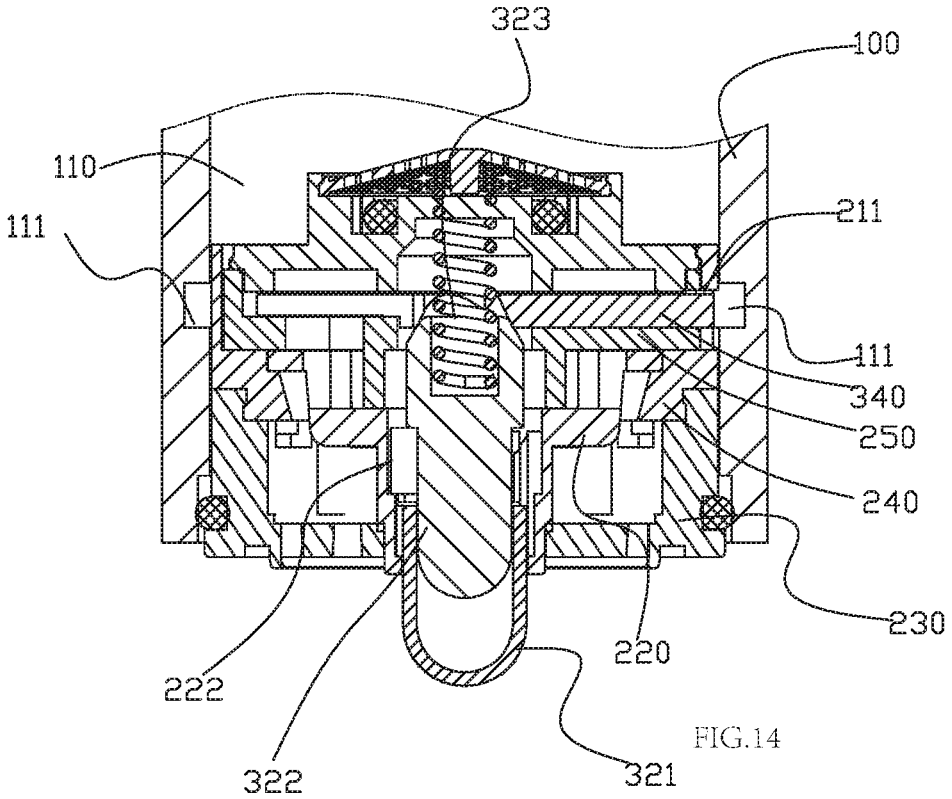
FIG. 14 illustrates a sectional diagram of a quick assembly and disassembly connecting structure in unlock state of the third embodiment.
Figure 15:
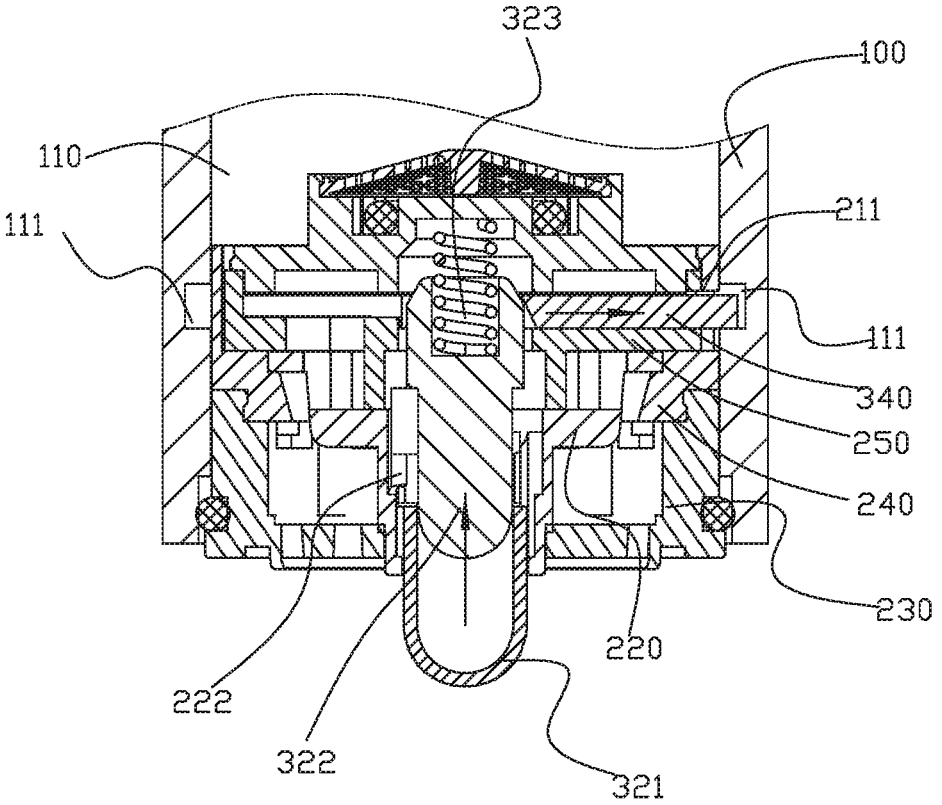
FIG. 15 illustrates a sectional diagram of the quick assembly and disassembly connecting structure in lock state of the third embodiment.

The third embodiment: this embodiment differs from the second embodiment in that: referring to FIGS. 12-15, two suspending sheets 341 form a splay shape with opening inwardly, the extending and retracting state of the push rod are respectively corresponding to the unlock position and lock position of the sliding block, the suspending sheet is compressed to restore energy during the sliding block moving from the lock position to the unlock position to generate an elastic force applying on the sliding block from the unlock position to the lock position. In lock state, the suspending sheet is in its natural state, thus lengthening the service life.

The assembly process: the jet regulator 200 is detachably assembled in the outlet passage 110 in the outlet direction, the assembly hole is aligned to the lock groove, pressing the button 321 of the retractable slide shaft driving mechanism, the push rod 322 is pushed to the extending position from the retracting position, during this process, the sliding block is subjected to the push rod and slides from the unlock position to the lock position, the suspending sheets are compressed to store energy, the push rod abuts against the sliding block to keep the sliding block in lock position. The unlocking process: pressing the button 321, the push rod 322 is reset to the retracting position from the extending position, the abutting to the sliding block is released, the elastic force of the suspending sheet makes the sliding block reset to the unlock position, the lock is released, the jet regulator is pulled out.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A quick assembly and disassembly connecting structure of an outlet terminal and a jet regulator, comprising:

an outlet terminal and a jet regulator, wherein the outlet terminal has an outlet passage, the jet regulator is detachably assembled in the outlet passage in an outlet direction, the jet regulator has a fixing shell portion, wherein an inner wall of the outlet passage of the outlet terminal is concaved with a lock groove, and the fixing shell portion has an assembly hole corresponding to the lock groove, the connecting structure comprises a lock portion and a retractable slide shaft driving mechanism with retracted and extended states, the lock portion is movably connected to the assembly hole and is movable between a lock position and a unlock position, the lock portion inserts into the lock groove in the lock position and retracts to the assembly hole and leaves the lock groove in the unlock position, the retractable slide shaft driving mechanism is assembled to the jet regulator and is connected to the lock portion, the retractable slide shaft driving mechanism is operated to change between two states to drive the lock portion to switch between the lock position and the unlock position, the jet regulator comprises a divider, the divider is fixedly assembled in the fixing shell portion, the assembly hole passes through the fixing shell portion, the fixing shell portion is coupled to the outlet passage, the retractable slide shaft driving mechanism comprises an assembly through hole disposed in the divider, a button movably connected to the assembly through hole, a push rod movably connected to the assembly through hole, and an elastic body abutting against the push rod and the jet regulator, and wherein the assembly through hole, the button and the push rod respectively have coupling incline teeth.

2. The quick assembly and disassembly connecting structure of an outlet terminal and a jet regulator according to claim 1, wherein the retractable slide shaft driving mechanism is disposed in the divider and has a push rod, the lock portion comprises a plurality of balls movably disposed in the assembly hole, a position block is disposed between the lock portion and the push rod, the position block is fixedly connected to the push rod, a first guiding mechanism is disposed between an end of the position block and the balls, with the first guiding mechanism, the position block moves to drive the balls to move to the lock position, a second guiding mechanism is disposed between the lock groove and the balls, and with the second guiding mechanism, the balls move to the unlock position.

3. The quick assembly and disassembly connecting structure of an outlet terminal and a jet regulator according to claim 2, wherein the end of the position block has a first guiding surface, and a side surface, parallel to a motion direction of the position block, which is connected to the first guiding surface, the first guiding surface and the ball couple to form the first guiding mechanism, the side surface abuts against the balls to keep the balls in the lock position, the lock groove has a second guiding surface, and the second guiding surface and the balls couple to form the second guiding mechanism.

4. A quick assembly and disassembly connecting structure of an outlet terminal and a jet regulator, comprising:

an outlet terminal and a jet regulator, wherein the outlet terminal has an outlet passage, the jet regulator is detachably assembled in the outlet passage in an outlet direction, the jet regulator has a fixing shell portion, wherein an inner wall of the outlet passage of the outlet terminal is concaved with a lock groove, and the fixing shell portion has an assembly hole corresponding to the lock groove, the connecting structure comprises a lock portion and a retractable slide shaft driving mechanism with retracted and extended states, the lock portion is movably connected to the assembly hole and is movable between a lock position and a unlock position, the lock portion inserts into the lock groove in the lock position and retracts to the assembly hole and leaves the lock groove in the unlock position, the retractable slide shaft driving mechanism is assembled to the jet regulator and is connected to the lock portion, the retractable slide shaft driving mechanism is operated to change between two states to drive the lock portion to switch between the lock position and the unlock position, the jet regulator comprises a divider, the divider is fixedly assembled in the fixing shell portion, the assembly hole passes through the fixing shell portion, the fixing shell portion is coupled to the outlet passage, the retractable slide shaft driving mechanism is disposed in the divider and has a push rod, the lock portion comprises a plurality of balls movably disposed in the assembly hole, a position block is disposed between the lock portion and the push rod, the position block is fixedly connected to the push rod, a first guiding mechanism is disposed between an end of the position block and the balls, with the first guiding mechanism, the position block moves to drive the balls to move to the lock position, a second guiding mechanism is disposed between the lock groove and the balls, and with the second guiding mechanism, the balls move to the unlock position, and wherein the fixing shell portion comprises a fixing ring and a guiding ring, a top end face of the fixing ring is concaved with a bottom throughout groove passing through the fixing ring inside and outside, a bottom end face of the guiding ring is concaved with a top throughout groove passing through the guiding ring inside and outside, the guiding ring and the fixing ring are fixed from up to down, the bottom throughout groove and the top throughout groove couple to form the assembly hole, an end of the position block slidably passes through the top throughout groove, and the balls are movably connected to the bottom throughout groove.

5. The quick assembly and disassembly connecting structure of an outlet terminal and a jet regulator according to claim 4, wherein a size of the bottom throughout groove is gradually decreased from inside to outside, and a width of an external opening of the bottom throughout groove is smaller than a diameter of the ball.

6. The quick assembly and disassembly connecting structure of an outlet terminal and a jet regulator according to claim 1, wherein the retractable slide shaft driving mechanism is disposed in the divider and is disposed with a push rod; the lock portion comprises a sliding block, a guiding mechanism is disposed between the push rod and the sliding block, the sliding block is slidably connected to the assembly hole, the end of the sliding block in the lock position extends out of the assembly hole and inserts to the lock groove, the end of the sliding block in the unlock position retracts to the assembly hole and leaves away from the lock groove.

7. The quick assembly and disassembly connecting structure of an outlet terminal and a jet regulator according to claim 6, wherein the sliding block is disposed with an elastically deformable suspending sheet, the extending and retracting state of the push rod are respectively corresponding to the unlock position and lock position of the sliding block, the suspending sheet is compressed to restore energy during the sliding block moving from the lock position to the unlock position to generate an elastic force applying on the sliding block from the unlock position to the lock position.

8. The quick assembly and disassembly connecting structure of an outlet terminal and a jet regulator according to claim 7, wherein the sliding block is disposed with two suspending sheets axially symmetrical arranged with respect to the sliding direction, two suspending sheets form a splay shape with opening inwardly, two suspending sheets doesn't leave away from the assembly hole when the sliding block is in the lock position.

9. The quick assembly and disassembly connecting structure of an outlet terminal and a jet regulator according to claim 6, wherein the sliding block is fixedly disposed with an elastically deformable suspending sheet, the extending and retracting state of the push rod are respectively corresponding to the unlock position and lock position of the sliding block, the suspending sheet is compressed to restore energy during the sliding block moving from the lock position to the unlock position to generate an elastic force applying on the sliding block from the unlock position to the lock position.

10. The quick assembly and disassembly connecting structure of an outlet terminal and a jet regulator according to claim 9, wherein the sliding block is disposed with two suspending sheets axially symmetrical arranged with respect to the sliding direction, two suspending sheets form a splay shape with opening inwardly, two suspending sheets doesn't leave away from the assembly hole when the sliding block is in the lock position.

* * * * *